US006602077B2

(12) United States Patent
Kasper et al.

(10) Patent No.: US 6,602,077 B2
(45) Date of Patent: Aug. 5, 2003

(54) HANDLE ASSEMBLY FOR MOTOR-VEHICLE DOOR LATCH

(75) Inventors: Andreas Kasper, Dülmen (DE); Jürgen Kill, Köln (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 10/136,867

(22) Filed: May 1, 2002

(65) Prior Publication Data

US 2002/0177331 A1 Nov. 28, 2002

(30) Foreign Application Priority Data

May 2, 2001 (DE) ..... 101 21 432

(51) Int. Cl.[7] ..... H01R 33/00
(52) U.S. Cl. ..... 439/34
(58) Field of Search ..... 439/34, 342, 343, 439/446, 533, 534, 476.4, 481; 16/412, 413; 292/336.3, DIG. 23

(56) References Cited

U.S. PATENT DOCUMENTS 4,041,301 A * 8/1977 Pelchat ..... 240/2.13
4,983,947 A * 1/1991 Mullen et al. ..... 340/426
5,725,262 A 3/1998 Kritzler
5,975,933 A * 11/1999 Yamaguchi et al. ..... 439/247
6,190,209 B1 * 2/2001 Hulsmann et al. ..... 439/660

FOREIGN PATENT DOCUMENTS

DE 196 33 894 2/1998

* cited by examiner

*Primary Examiner*—Ross Gushi
(74) *Attorney, Agent, or Firm*—Herbert Dubno; Andrew Wilford

(57) ABSTRACT

A handle assembly for a motor-vehicle door latch has an adapter plate shaped to fit on a motor-vehicle door and forming a pivot and a seat, an electrical connector sleeve snugly fittable in the seat, and a handle having an arm fittable in the connector sleeve and with the pivot. The handle is movable between a partially installed position and a fully installed position. In the partially installed position the arm snugly engages in the connector, the connector is snugly fitted in the seat, and the arm is out of engagement with the pivot. In the fully installed position the arm is still engaged snugly in the connector but the connector is pulled out of the seat, and the arm is in pivotal engagement with the pivot and pivotal about the pivot jointly with the connector sleeve.

11 Claims, 3 Drawing Sheets

HANDLE ASSEMBLY FOR MOTOR-VEHICLE DOOR LATCH

FIELD OF THE INVENTION

The present invention relates to a handle assembly for a motor-vehicle door latch. More particularly this invention concerns such a handle to which an electrical connection is made, for instance for a keyless entry system.

BACKGROUND OF THE INVENTION

A standard pull-type motor-vehicle door latch as described in U.S. Pat. No. 5,725,262 has an actuating element serving to open the latch and normally vertically displaceable inside the door. An actuating system for the latch mounted on the door edge has a handle, a mounting plate supporting the handle on an outer panel of the door above the latch, and a pivot on the mounting plate for horizontal pivotal movement of the handle on the plate between an unactuated position generally flush with the door and an actuated position spaced horizontally outward from the door. A coupling lever pivoted on the door about a horizontal axis has one arm connected to the handle and another arm. A link extends vertically between the other arm and the vertically displaceable actuating element so that when the handle is displaced horizontally into the actuated position the lever is pivoted and the link is displaced vertically. Such a latch can be used on any door of a vehicle, and even on its trunk or rear hatch.

In addition it is known, for example from German patent 196 33 894 of R. Wittwer to make an electrical connection with the pivotal handle, either to use it as an electrode of a capacitative sensor or to connect to some sort of sensor built in to the handle. Such an arrangement is used in a central-lock system, for example of the keyless entry type where the user carries a transducer that is interrogated when the controller in the car determines that someone is touching the door handle. Thus if a user carrying the appropriate transducer places a hand on the door handle, the transducer carried by the user is interrogated and, if it is appropriately coded, the control system unlocks the door so actuation of the handle opens it. Thus a user carrying the appropriately coded transducer unlocks the door simply by touching the latch handle while the controller leaves the latch locked when the appropriately coded transducer is not nearby.

The adapter plate is typically made of a durable and insulating synthetic resin and the handle is at least partially made of or coated with a conductive metal. The connection to the handle is established after it is fully mounted, that is after the adapter plate has been secured to the door and the handle fitted to the adapter plate so it can pivot as described above. Thus the connector is mounted on the latch and only actually engages the handle when the handle is moved in its final assembly stage into position on the adapter plate, typically by being slid parallel to the door plane to engage a pivot fork on the handle over a pivot pin on the adapter plate. Only at this last stage is the actual electrical connection made.

The connection to the handle must not interfere with pivoting of the handle and must maintain a good electrical contact with the handle as it is moved. Forming such a good contact is thus somewhat difficult. Furthermore the contact can only be tested once the entire latch and door are assembled, so that if the contact is bad the assembly must be taken apart.

OBJECTS OF THE INVENTION

It is therefore an object of the present invention to provide an improved handle assembly for a motor-vehicle door latch.

Another object is the provision of such an improved handle assembly for a motor-vehicle door latch which overcomes the above-given disadvantages, that is which allows a good electrical connection to be made to the handle in a manner that can be tested before assembly of the latch and that allows the latch to be put together in a simple manner.

SUMMARY OF THE INVENTION

A handle assembly for a motor-vehicle door latch has according to the invention an adapter plate shaped to fit on a motor-vehicle door and forming a pivot and a seat, an electrical connector sleeve snugly fittable in the seat, and a handle having an arm fittable in the connector sleeve and with the pivot. The handle is movable between a partially installed position and a fully installed position. In the partially installed position the arm snugly engages in the connector, the connector is snugly fitted in the seat, and the arm is out of engagement with the pivot. In the fully installed position the arm is still engaged snugly in the connector but the connector is pulled out of the seat, and the arm is in pivotal engagement with the pivot and pivotal about the pivot jointly with the connector sleeve.

Thus the connector is mounted on the adapter plate by the latch manufacturer. Subsequently the connection between the handle and the connector is made by inserting an extension of the handle arm into the sleeve or by fitting the sleeve over the arm extension. Only subsequently when the arm is shifted into the fully installed position is the connector moved out of the seat holding it so that the arm and connector can pivot jointly in the adapter plate. The connection between the arm and the connector is established before the arm is moved into its final position on the adapter plate, allowing this connection to be tested before final fitting of the handle when disassembly of the latch becomes much more difficult.

According to the invention the handle moves longitudinally between the partially and fully installed positions. The connector sleeve is open transversely so that the arm fits transversely into it. A door panel in which the adapter plate is fitted extends longitudinally also.

Furthermore in accordance with the invention formations on the connector sleeve and on the adapter plate releasably clipping the connector sleeve in the seat. These formations include an elastically deformable clip arm having an end deflectable transversely and engageable in a transversely open seat or recess of the connector sleeve.

Also according to the invention the seat and connector sleeve are formed with interfitting formations permitting only relative longitudinal movement of the adapter and sleeve. These formations include a longitudinally extending groove and a pin fittable in the groove. The groove is formed in the seat and the pin is provided on the connector sleeve. Moreover to solidly retain the connector sleeve in the partially assembled position and before the handle is fitted to it, the groove has a narrow inner end dimensioned to snugly pinch the pin and a wider outer portion dimensioned to loosely received and guide the pin.

The arm according to the invention is formed with a longitudinally open seat engaged around the pivot in the fully assembled position. In addition the handle is provided with a proximity sensor connected to the sleeve when the connector sleeve is fitted to the arm in both of the positions of the handle.

BRIEF DESCRIPTION OF THE DRAWING

The above and other objects, features, and advantages will become more readily apparent from the following description, reference being made to the accompanying drawing in which.

SPECIFIC DESCRIPTION

Figure 1A:
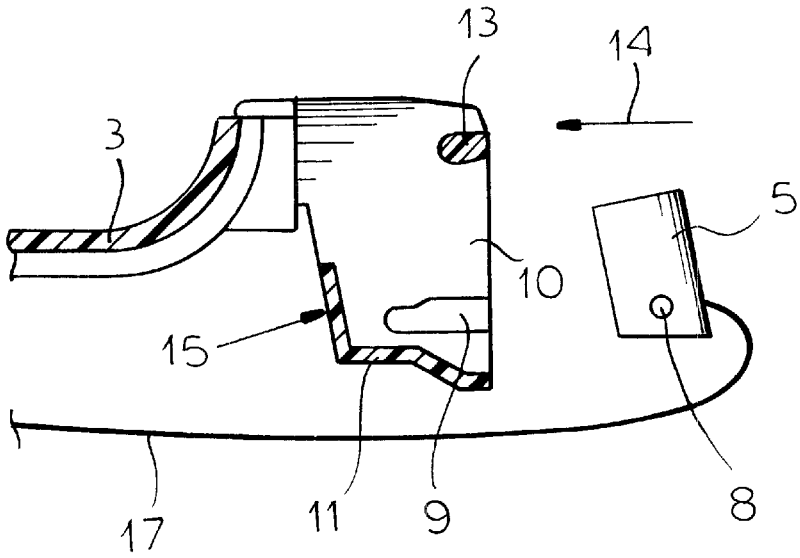
FIGS. 1*a* and 1*b* are views illustrating two first steps in putting together the latch according to the invention.
Figure 1B:
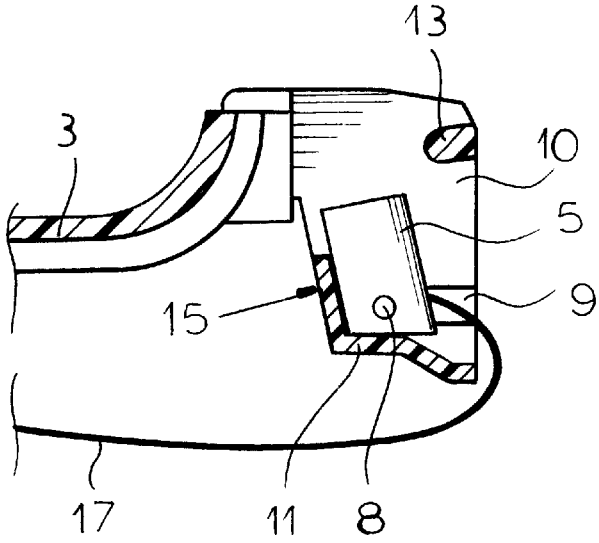
Figure 2A:
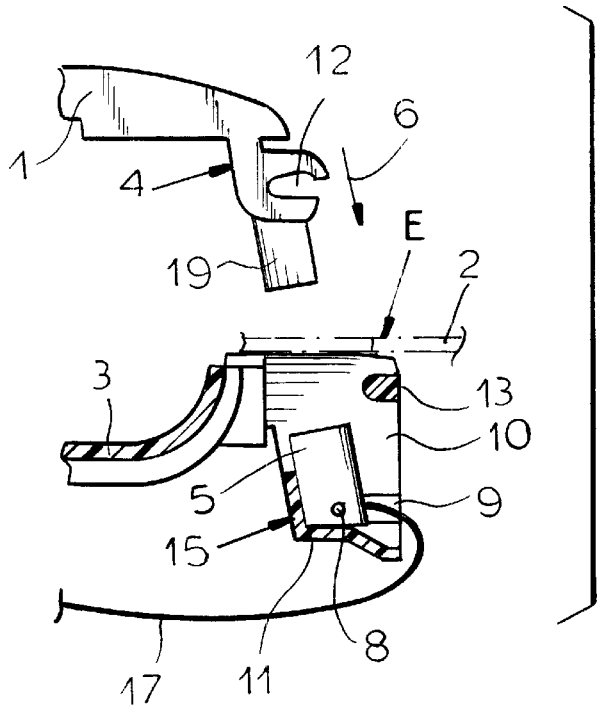
FIGS. 2*a*, 2*b*, and 2*c* are views like FIG. 1 showing the subsequent steps in mounting and assembling a latch in accordance with the invention.
Figure 2B:
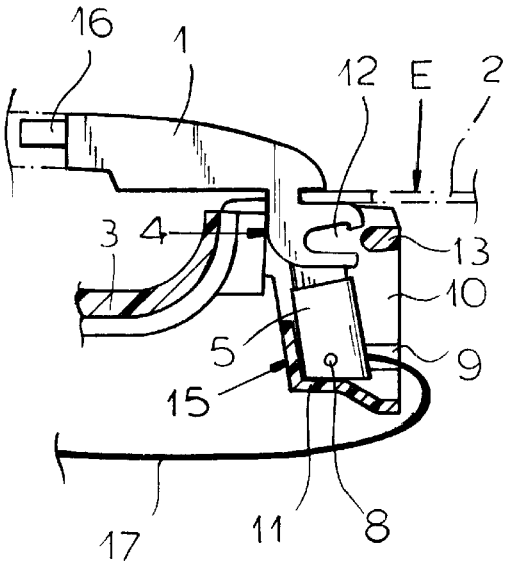
Figure 2C:
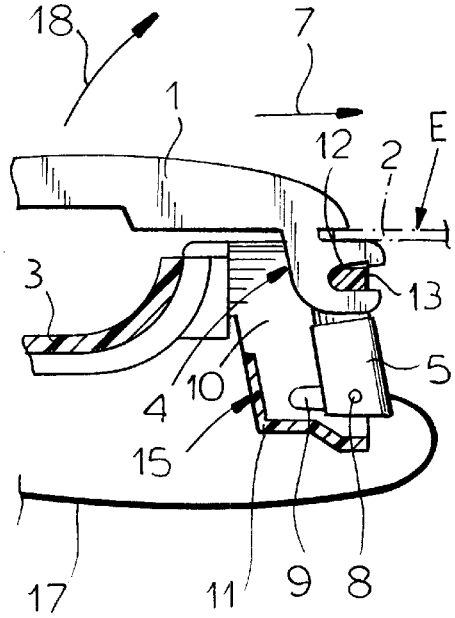

As seen in FIGS. 1*a* and 1*b* a door-latch subassembly according to the invention has an adapter plate 3 normally made of a rigid plastic and adapted to be fitted to a hole in a door panel 2 (FIGS. 2*a*–2*c*). This plate 3 has a pair of parallel side walls 10 bridged by a floor 11 and forming a pocket: or seat 15 that is open in a direction 7 (FIG. 2*c*) parallel when installed to a plane E of the door panel 2 and generally perpendicular to this plane E. A pivot pin 13 extends between the side walls 10.

An electrical connector sleeve 5 having a lead 17 is shaped to fit complementarily in this seat 15. To this end the side walls 10 have grooves 9 open toward each other and extending in the direction 7 and the connector 5 has pins 8 that project outward and that can slide along the grooves 9. The inner ends of the grooves 9 are somewhat narrower than their outer regions.

Figure 3:
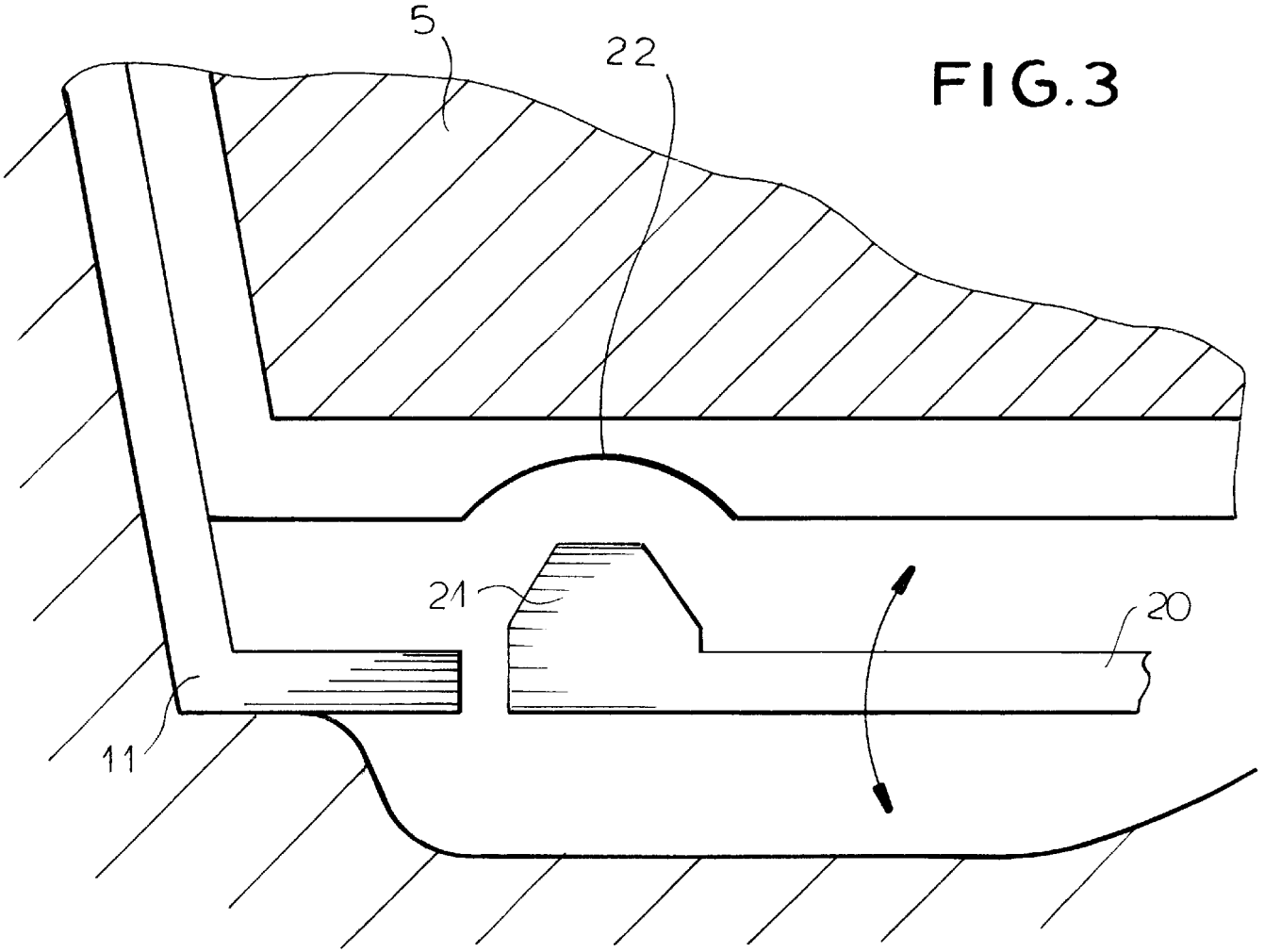
FIG. 3 is a large-scale sectional view of a detail of the latch according to the invention.

Thus the connector 5 can be mounted on the plate 3 at a part-supplier plant on the adaptor plate 3 by pushing it in the direction 14 parallel to the plane E into the seat 15. The narrowed inner ends of the grooves 9 ensure that as the pins 8 move inward they are pinched somewhat to hold the connector 5 solidly in place. As shown in FIG. 3 the floor 11 of the seat 15 is formed with a deflectable finger 20 having an end 21 engageable upward into a notch 22 formed in the bottom of the connector 5. These formations 20, 21, and 22 therefore serve to releasably retain this connector 5 in the seat 5. This subassembly is then shipped to the final assembly factor for mounting in a door.

The subassembly of the plate 3 and connector 5 is then as shown in FIG. 2*a* secured to the door panel 2, which can be an inside or outside panel although here it is the latter, and a handle 1 having a pivot arm 4 is pressed in a direction 6 into the assembly. This fits an extension 19 at the end of the arm 4 into the sleeve connector 5 as shown in FIG. 2*b*. In this position the connector 5 is still solidly held in the seat 15 but it makes a good electrical connection with the extension 19 that is connected to a proximity sensor 16 in the handle 1. The connection could also be optical, for instance via an optical fiber conductor for infrared or light-curtain sensors.

Then as shown in FIG. 2*c* the handle 7 is slid in the direction 7 to engage a fork 12 formed on the arm 4 over the pivot pin 13. This pulls the connector 5 out of the seat 15 while still leaving it solidly mounted on the extension 19. Thus even when the handle 1 is pivoted as indicated by arrow 18 around the pin 12, the connector 5 will be able to follow this pivoting and maintain the electrical connection as it is no longer snugly gripped in the seat 15 by the interfit of the pins 8 in the grooves 9 and of the formations 20–22.

Thus it is possible to mount the connector 5 on the adapter plate 3 at the plant where this subassembly is made. When the latch is eventually assembled on the door, it can be counted on to stay in place and maintain the needed electrical connection.

We claim:

1. A handle assembly for a motor-vehicle door latch, the handle assembly comprising:

an adapter plate adapted to fit on a motor-vehicle door and forming a pivot and a seat;

an electrical connector sleeve snugly fittable in the seat; and a handle having an arm fittable in the connector sleeve and with the pivot, the handle being movable between a partially installed position with the arm engaging snugly in the connector, the connector snugly fitted in the seat, and the arm out of engagement with the pivot and a fully installed position with the arm engaged snugly in the connector, the connector pulled out of the seat, the arm in pivotal engagement with the pivot, and pivotal about the pivot jointly with the connector sleeve.

2. The door-latch handle assembly defined in claim 1 wherein the handle moves longitudinally between the partially and fully installed positions, the connector sleeve being open transversely so that the arm fits transversely into it.

3. The door-latch handle assembly defined in claim 1, further comprising a door panel in which the adapter plate is fitted and which extends longitudinally.

4. The door-latch handle assembly defined in claim 1, further comprising means including formations on the connector sleeve and on the adapter plate for releasably clipping the connector sleeve in the seat.

5. The door-latch handle assembly defined in claim 1 wherein the arm has an extension complementarily fittable in the connector sleeve.

6. The door-latch handle assembly defined in claim 1 wherein the handle moves longitudinally between the positions a and the arm is formed with a longitudinally open seat engaged around the pivot in the fully assembled position.

7. The door-latch handle assembly defined in claim 1 wherein the handle is provided with a proximity sensor connected to the sleeve when the connector sleeve is fitted to the arm in both of the positions of the handle.

8. The door-latch handle assembly defined in claim 1, wherein the seat and connector sleeve are formed with interfitting formations permitting only relative longitudinal movement of the adapter and sleeve.

9. The door-latch handle assembly defined in claim 8 wherein the formations include a longitudinally extending groove and a pin fittable in the groove.

10. The door-latch handle assembly defined in claim 9 wherein the groove is formed in the seat and the pin is provided on the connector sleeve.

11. The door-latch handle assembly defined in claim 9 wherein the groove has a narrow inner end dimensioned to snugly pinch the pin and a wider outer portion dimensioned to loosely received and guide the pin.

* * * * *